United States Patent [19]

Garrett

[11] Patent Number: 4,586,625

[45] Date of Patent: May 6, 1986

[54] SINGLE USE BEVERAGE CONTAINER TOP

[75] Inventor: Ernest Garrett, Granada Hills, Calif.

[73] Assignee: Top Notcher Enterprises, Inc., Granada Hills, Calif.

[21] Appl. No.: 569,952

[22] Filed: Jan. 11, 1984

[51] Int. Cl.[4] ..... B65D 41/56

[52] U.S. Cl. ..... 220/266; 220/90.2; 220/90.4; 229/7 R; 229/7 S

[58] Field of Search ..... 220/90.2, 90.4, 266; 229/7 R, 7 S

[56] References Cited

U.S. PATENT DOCUMENTS

| | | | |
|---|---|---|---|
| 3,048,317 | 8/1962 | Cochrane et al. | 229/7 S |
| 3,301,459 | 1/1967 | Gardner | 229/7 R |
| 3,524,566 | 8/1970 | Parks | 229/7 S |
| 3,800,999 | 4/1974 | Serritella | 220/90.4 X |
| 4,090,660 | 5/1978 | Schram et al. | 220/90.2 |
| 4,113,135 | 9/1978 | Yamazaki | 220/90.4 X |
| 4,186,842 | 2/1980 | Albert | 220/90.4 X |
| 4,333,583 | 6/1982 | Montemarano | 220/90.4 |
| 4,412,629 | 11/1983 | Dart et al. | 220/90.4 |

*Primary Examiner*—Allan N. Shoap
*Attorney, Agent, or Firm*—John E. Wagner

[57] ABSTRACT

A single beverage container top provides an arcuate-shaped opening within an edge rim. The arcuate-shaped opening is defined by a first severance line. A truncated cone portion within the first severance line comprises a handle for opening the arcuate opening. A second severance line on the truncated cone handle provides a sanitary straw opening.

2 Claims, 26 Drawing Figures

A
B

C
D

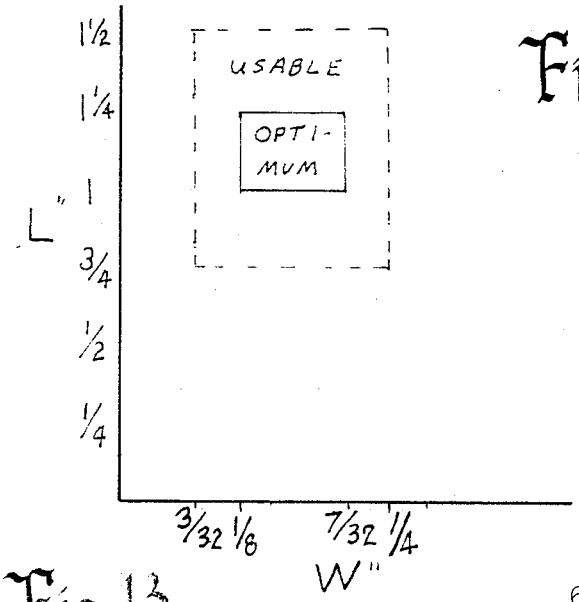
Fig. 13
Fig. 14
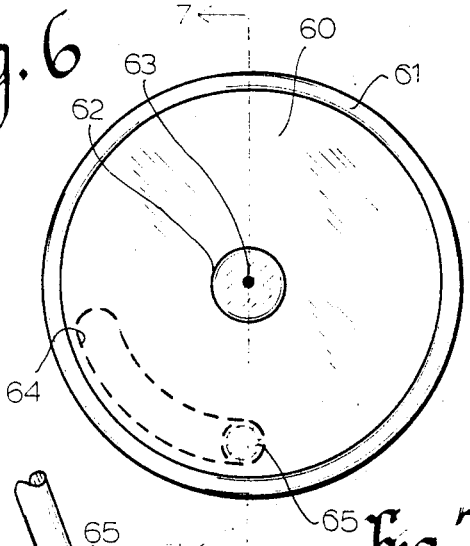
Fig. 6
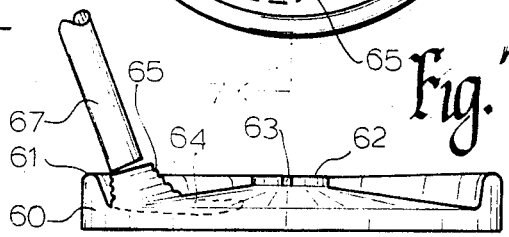
Fig. 7
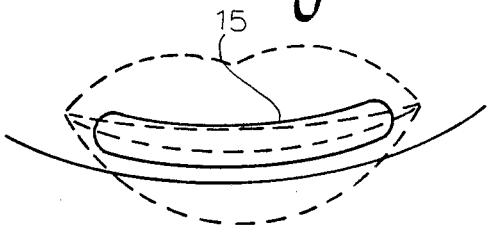
Fig. 11
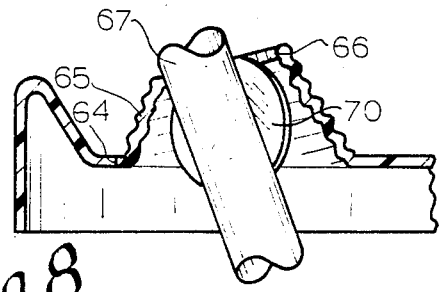
Fig. 8
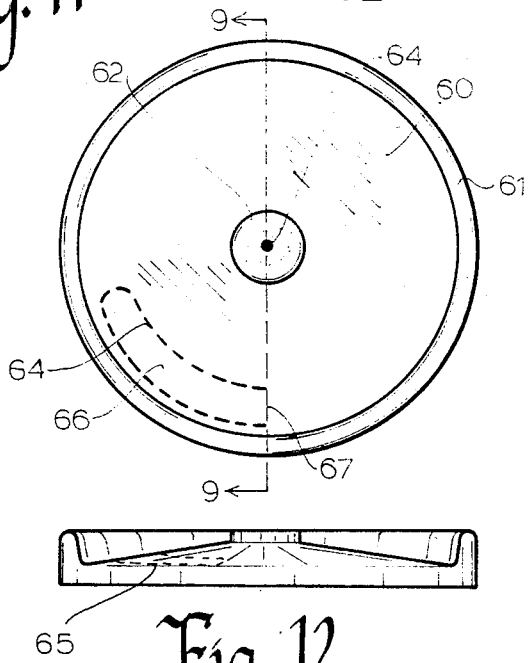
Fig. 12
Fig. 9
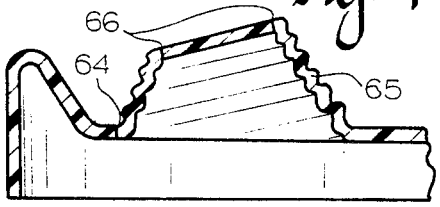
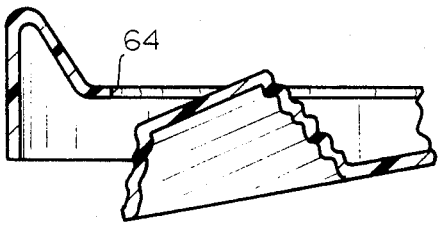
Fig. 10

SINGLE USE BEVERAGE CONTAINER TOP

BACKGROUND OF THE INVENTION

For many years the takeout food industry has been growing and a larger and larger percentage of beverages such as coffee, tea, juices and carbonated drinks are served in paper or plastic cups with a plastic snap-on cover. Usually the beverage is consumed by removing the cover or by sipping through a straw which penetrates the cover through crossed slot openings or punch-out openings dimensioned to receive the straw.

In the case of hot beverages such as coffee or tea, the cover is usually removed. When the consumer of a hot beverage intends to drink the beverage under conditions in which the beverage may spill, e.g. in a moving vehicle, the removal of the cover becomes an invitation to spillage, and if the consumer is the driver of the vehicle, perhaps a dangerous condition presented. The driver may be distracted by beverage spillage and fail to pay attention to the act of driving.

Some drivers tear a triangular opening in the edge of the plastic cup lid, and some plastic cover manufacturers have produced such triangular or pie-shaped openings in their lids.

Probably the most satisfactory cup for use by a driver of a vehicle is the permanently covered plastic cup with a spring-loaded closure opened by a push button or trigger. Such a device, however is not adaptable to a single use cup and lid.

REFERENCE TO RELATED APPLICATIONS

A device for punching openings in single use beverage container lids is disclosed and claimed in my prior U.S. Pat. No. 4,291,464, issued on Sept. 9, 1981. A copending application, for a CONTAINER TOP, filed Jan. 16, 1984, Ser. No. 570,974, discloses and claims an improved top for cans and other containers in which the top is permanently affixed to the can or container.

BRIEF DESCRIPTION OF THE INVENTION

Faced with the total lack of a satisfactory single use cup and lid in which the customer may consume either hot or cold liquids without removal of the lid, I determined that it was essential that a thorough study of the beverage consumption process be conducted in order to fill this need.

I also undertook to determine if the straw, commonly used to consume cold carbonated and/or sweet beverages, is truly optimum.

I undertook a study of existing beverage containers and their means of dispensing as compared with the physiology of the taste function of the mouth.

It is known that taste buds which respond to different types of flavors are located at different positions on the top and sides of the tongue and that they are temperature sensitive. As an example, the taste buds which respond to sweet flavors are located at the front of the tongue while those which detect bitter flavors are farther to the rear. Since most of the beverages which we consume are desired to be more sweet than bitter, it would appear to me that the exciting of the taste buds at the front of the tongue should be enhanced, if possible, in the drinking process.

The straw which is commonly used to consume sweetened beverages such as soft drinks, tends to deliver a round stream of the beverage to the rear of the mouth where the bitter responsive taste buds are located. It is only through reverse flow of the beverage within the mouth of the drinker that the sweetened beverages reach the sweet flavor responding taste buds. Perhaps this accounts for the practice of many to draw on a straw to fill their mouth, slosh the beverage around the mouth, and then swallow it. I would assume that only a small portion of the beverage actually contacts the taste buds, i.e. the thin film which comes in contact with the sweet flavor responding taste buds. It therefore appeared to me that what is really needed in consuming sweet beverages is some means to allow their entry into the mouth in a thin sheet of fluid which passes directly over the taste buds at the front of the mouth.

I also felt that the discomfort which hot beverage drinkers experience when gulping an extremely hot beverage could be eliminated. I believed that this could be accomplished if the beverage were delivered to the mouth in a thin sheet, thereby having less heat energy content per unit of area, whereby the lips and tongue may absorb the energy at a slower rate and not desensitize the taste buds or receptors, nor cause discomfort to the drinker.

I noted that the human lips may be pursed to accomplish what I consider to be the desired arrangement of a thin sheet of fluid into the mouth. This does not occur when people "gulp" down fluids with a recognized loss of flavor.

Faced with this situation, I endeavored to design a single use cup lid which:

1. Provides a means for consuming both hot and cold fluids without removal of the lid;
2. Provides a thin sheet of fluid to the drinker's mouth;
3. Provides the thin sheet of fluid at the front of the tongue;
4. Provides protection against spillage while in transit or during consumption by the user;
5. Provides enhanced detection for sweet and other flavors in beverages;
6. Avoids scalding of the tongue and mouth by excessively hot beverages;
7. Allows the use of a straw, if desired;
8. Allows convenient partial or total removal of a portion of the beverage container top by the consumer; and
9. Is easy to use and does not require unnatural drinking techniques.

These objectives are all acomplished in accordance with this invention, in which I employ a formed plastic cup lid having an edge recess to receive the lip of a cup and a thin arcuate or curved opening extending around the periphery of the region within the confines of the edge recess. The arcuate opening in the lid is dimensioned to confine the beverage to a sheet as it enters the mouth. This provides an adequate stream for consuming yet provides for optimum flavor detection.

BRIEF DESCRIPTION OF THE DRAWING

This invention may be more clearly understood from the following detailed description and by reference to the drawing in which:

FIGS. 2A, B, C, and D, constitute perspective views of a variety of prior art beverage containers and tops;

FIG. 6 is a top plan view of a fourth alternate embodiment of this invention;

FIG. 7 is a sectional view taken along line 7—7 of FIG. 6;

FIGS. 8 through 10 are fragmentary vertical sectional views of the embodiment of FIG. 7 when in use;

FIG. 11 is a top plan view of a fifth alternate embodiment of this invention;

FIG. 12 is a sectional view of the top of FIG. 11 taken along lines 12—12 of FIG. 11;

FIG. 13 is a graphical presentation of the length and width parameters of openings in accordance with this invention;

FIG. 14 is a simplified representation of the opening of this invention and the user's mouth;

DETAILED DESCRIPTION OF THE INVENTION

In order to understand this invention more fully and to recognize its significance with respect to consumption of fluids from containers, it is important that the reader have an understanding of the physiology of drinking fluids, particularly soft drinks, served cold, and hot beverages such as coffee. The consumption of beverage is not only required to supply water for the body but is motivated by the desire to satisfy taste. An understanding of the taste sense is therefore desirable.

Description of Taste Sensation

The mouth region of humans contains taste receptors which are stimulated by substances during eating and drinking. Food taste and flavor perception are a composite of sensory organs as well as pressure, temperature, pain, odor and other complex psychological factors including cultural conditioning, social usage and packaging.

Figure 15:
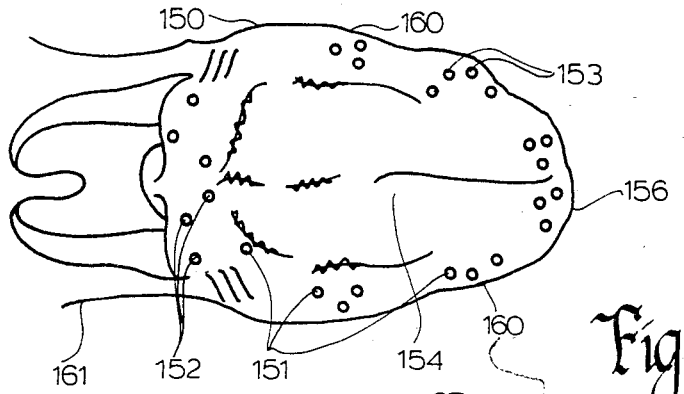
FIG. 15 is a top plan view of a human tongue.

Primary sensory organs for taste are located on the tongue as illustrated in FIG. 15 and are goblet-shaped clusters of cells (taste buds) that open by a small pore. Sensory nerve fibers enter the taste buds, entwine, and contact one or more taste cells. Nerves to the tongue transmit sensory impulses received by this "taste" system, sending the signals on to the central nervous system for final perception.

The mouth cavity also is in open communication with the nasal cavity, and aromatic substances can diffuse up to the odor receptors in the nose and give rise to other sensations. Furthermore, there are thermo-receptors, mechano-receptors, and pain fibers in the mucus membranes of the mouth and tongue which also may be stimulated. What is usually called a "taste", therefore, is actually a multimodal sensation, in which many other elements are superimposed on the real gustatory sensation.

Structure of the Tongue

The surface of the human tongue typified by FIG. 15 is covered with a mucus membrane, folded at many points to form little peglike projections called papillae. There are three types of taste buds having papillae-vallate, foliate, and fungiform. The papillae differ in their distribution, however, and only the fungiform are scattered over the entire surface. The vallate papillae, of which there are only 7 to 12 in humans, appear from above to be round structures 1 to 3 mm. in diameter: they are restricted to a zone across the back of the tongue near its base. The third type foliate, are arranged along the edges of the tongue. A fourth type, filiform covers the remaining surface of the tongue but they bear no taste buds.

The term "bud" refers to the shape of these taste organs. Their location on the papillae varies; in the case of vallate and foliate, there are many taste buds in the side walls, but none on top. In the fungiform, the taste buds are limited to the surface of the "cap" of the "mushroom," which may be as much as 1 mm in diameter.

A human has about 2000 taste buds, roughly half of which are on the vallate papillae. Each taste bud contains 40 to 60 individual sensory receptor cells. Embedded in the connective tissue below the vallate and foliate papillae are serous glands with ducts opening in the depressions between papilla and wall, or between neighboring papillae. Their secretion serves to wash away particles of food and microorganisms. In addition, the presence of this secretion lowers the concentration of stimilus substance in the vicinity of the taste buds.

Water-soluble substances that reach the surface of the tongue can diffuse through a pore into a fluid filled space over the taste bud; here they contact thin membranes which form the outer ends of taste receptor cells. Liquid substances constantly bathe these receptors with stimulus molecules from liquids or food substances. Receptor cells are constantly scanning molecules from the stimulus and when a specific molecule matches with a specific receptor, their response is transmitted by special fibers to form synapses near the base of the sensory cells. Responses of the aggregate of taste buds are then transmitted by special nerves to the brain where these signals are combined with other complex factors to form final taste perception.

There is a maximum number of molecules which an individual receptor can accept. Selection of specific molecules from the stimuli substance eventually ends when the receptor cell can no longer absorb more molecules. Once the saturation point is reached, a receptor simply rejects additional molecules until its impulses have been transmitted. Following transmission, the recptors are again free to begin scanning and accepting specific stimuli molecules. Flushing of stimuli substances, food particles and other microorganisms is constantly taking place, thus exposing the receptors to new molecules.

It has been observed that the ability of cells to receive and transmit stimuli may change over a period of time. The life span of sensory cells in taste buds is short; there is a continual exchange of sensory cells. On the average, a sensory cell is replaced by its successor after only ten days. The lost cells are replaced by new sensory cells and during the changeover, synapses between the special transmitting fibers and the old cells must be disrupted and new synapses formed. Taste buds actually may temporarily be desensitized. The new sensory cells differ in their sensitivity to various stimuli and may result in a change in the over all taste profile. This situation is often referred to as the adaptive ability of taste buds and may result in a lessened capability to perceive maximum flavor.

Olfactory System and Taste

It has been determined that the olfactory sensory system (smell) has a very significant influence on taste perception. The sense of smell is active, not only before food or drink is taken, but during the ingestion itself. The aroma released by fragrant parts of the substance is inhaled and penetrates the back-throat and nasal chambers.

It is well known among individuals that one's sense of "taste" can be distorted, or even lost, when the olfactory system is disrupted by colds and other nasal problems.

Basic Taste Sensations

Four quite distinct, basic taste sensations have been identified: sweet, sour, salty, and bitter. Apart from these basic qualities, two accessory qualities of alkaline and metallic can also be distinguished. In the case of odors, however, it is difficult to arrange the many different stimuli in groups of related substances which can be regarded as odor qualities.

A classification of flavors has often been attempted, but as there is no standard measurement, such classification remains vague and uncertain. As already stated, it is possible to distinguish tastes that are sweet, sour, salty and bitter, but the difficulty lies in establishing a demarcation between one type and another. Sweet, sour and salty tastes, however, are generally better perceived when cold than when hot.

Intensity of Taste

It is well established that taste buds are dispersed throughout the tongue and mouth. Different regions of the tongue vary in sensitivity to the four basic taste qualities. The tip of the tongue as illustrated in FIG. 15 is particularly sensitive to sweet substances, and the outer edges of the middle parts of are most responsive to sour stimuli. Salty stimuli are most effective in an area on the edge of the tongue that partially overlaps these two regions. Bitter substances affect most strongly the receptors near the base of the tongue.

A simple comparison of different test solutions indicates that the intensity of a taste sensation depends upon the concentration of the substance over the taste receptors. In threshold determinations, it turns out that the effect of diluting a solution of stimulus substance can be compensated by stimulating a larger area on the surface of the tongue. This test shows that a diluted substance spread over a larger area of the tongue produces the same level of taste as a heavier concentration on a smaller area of the tongue.

There is also a corresponding relationship between concentration and duration of a stimulus to the receptors. The longer a stimulus substance is exposed to the receptors, the better the flavor is perceived. It must be kept in mind, however, that the sense of taste exhibits a definite adaptative capability and, during long exposure, the intensity of the sensation will actually decrease.

DESCRIPTION OF THE EMBODIMENTS OF THE INVENTION

Figures 1, 2, 3, 4, 5, 5A, 5B:
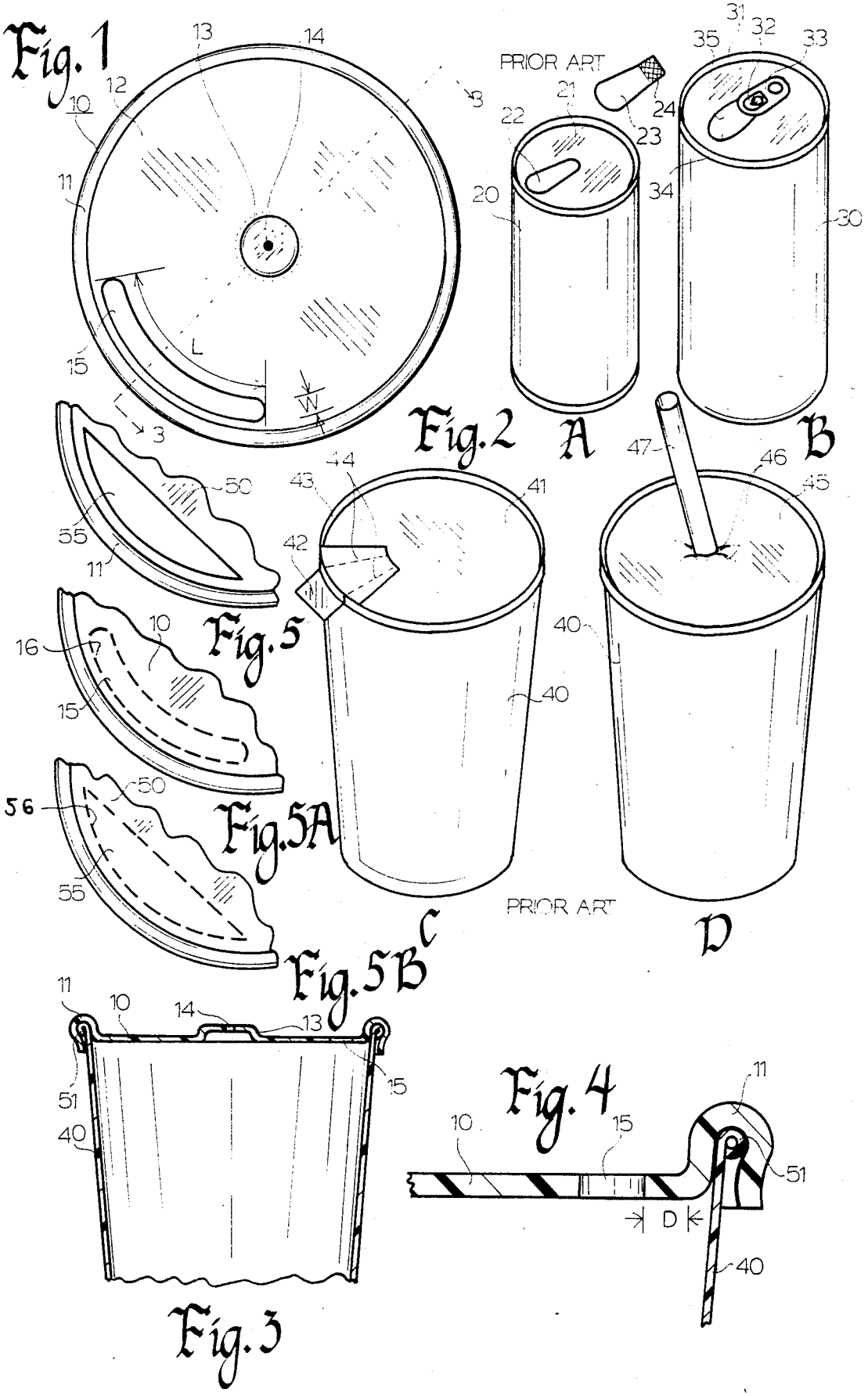
PRIOR ART Fig. 5
PRIOR ART Fig. 4
FIG. 1 is a top plan view of a plastic one time use beverage container top incorporating this invention.
FIG. 3 is a sectional view of a container and top in accordance with FIG. 1 taken along lines 3—3 of FIG. 1.
FIG. 4 is an enlarged fragmentary sectional view similar to FIG. 3 showing certain of the slot details.
FIG. 5 is a fragmentary top plan view of an alternate shape of opening in a top similar to that of FIG. 1.
FIG. 5A is a fragmentary top plan view of a second alternative configuration of the opening in accordance with this invention.
FIG. 5B is a fragmentary top plan view of a third alternative configuration of the opening in accordance with this invention.

Now referring to FIG. 1, a top 10 of a single service beverage container, such as a paper cup, is illustrated as including an edge rim 11, designed to snap over the upper lip of the cup. The rim 11 encircles a slightly lower domed body portion 12 having a central column 13, preferably with an air hole 14. As described so far, the cover 10 is of the type used in quantities of millions each year throughout the world. The distinction from the prior art becomes immediately apparent in FIG. 1 in the form of an opening 15 having a smile-shape and curved to generally parallel rim 11. The opening 15 has a length "L" and width "W" within the limits set forth below, but in general is dimensioned to conform to the shape of the mouth while drinking and provides a thin sheet of beverage from the container spread across the top surface of the tongue of the user. Note that the rim 11 is not interrupted in any way by the opening 15.

The lid of FIG. 1 contrasts markedly from the prior art containers as illustrated in FIG. 2. In FIG. 2A a typical juice container 20 is illustrated in the form of a metal can having a metal lid 21 with an elongated opening 22 extending generally radially and enlarged towards the edge of the can lid 21. Typically, such an opening has been covered by an adhesive coated metal closure 23 having a pull tab 24.

Another form of prior art is illustrated in FIG. 2B, and this type of container is customarily found in use for soft drinks and beer. The container 30 is of steel or aluminum and has an aluminum top 31 with an integral rivet 32 securing a ring tab 33. The ring tab 33 when raised causes the application of localized pressure to the region 34 which is surrounded by a fracture line or partially die cut line 35. This produces an opening, generally oval shaped as outlined by the fracture line 35.

Another form of prior art is a conventional wax paper cup 40 illustrated in FIG. 2C having a plastic lid 41 of a silimar shape in material to the lid of FIG. 1 with the exception that the lid 41 has a pull tab 42, secured to a section of the rim 43 and a series of fracture lines 44. When the pull tab 42 is lifted with the top 41 on the container 40, the lid tears along the fractured line 44 providing a trapezoidal opening. The tab 42 remains attached to the lid and must be folded back to avoid interference with drinking. Important to note that in the embodiment of FIG. 2C, represented in prior art, the lid rim 43 is severed reducing its overall strength. Typically, if a container of the type shown in FIG. 2 having had the tab 42 lifted and the rim fractured, falls over, or if the container sides are squeezed slightly, the lid usually leaves the container and the contents spill. Therefore, the development of an effective cover, which does not sever the rim of the cover, and still provides an effective drinking opening, is important.

FIG. 2D illustrates a similar type of container 40 having a lid 45 with a pair of cross slits 46 at the center. These slits allow a straw 47 to be inserted through the cross slits 46 and the contents of the container 40 consumed through the straw 47. The contents can only be consumed through the straw when the entire lid 45 is removed.

Now referring to FIGS. 3 and 4, the relationship of the lid 10, rim 11, and the cup 40 for a more detailed showing of this invention, may be more clearly seen. The cup 40 includes an upper rolled lip 51, which provides structural rigidity for the top of the cup and allows the lid 10 to be snapped over the lip 51. The central column 13, and air hole 14 which is commonly found in cups of this type is clearly shown in FIG. 3. The width of the opening 15, and its positioning relative to the rim 11 is illustrated particularly in FIG. 4. Although the opening 15 can well extend to the very inner edge of the rim 11, likewise it may be located radially inward by distance "D" from the rim 11. The rigidity of the rim 11 is not interrupted by opening 15 and the lid 10 will remain on the cup 40 as well as the version of FIG. 2D.

Although the preferred form of the opening 15 is as illustrated in FIG. 1, another form of opening appears in FIG. 5. In this case a lid 50 including a standard rim 11 has an opening 55 in the form of a segment of a circle with the circle concentric with the center of the lid 50. The opening again is located within the rim and close to it. If the width of the opening 55 falls within the parameters as set forth in FIG. 13, the advantages of this invention will be realized. Also the pointed edges of the opening are much like the person's lips when pursed to drink a beverage. The edges can allow air entry into the cup without spillage of beverage. This embodiment is particularly important in lids which do not have top air holes such as the vent 14 of FIG. 1.

Although this invention involves the size and shape of the drinking opening in a beverage container lid and is unusable as intended without an opening being present, lids in accordance with this invention may be sold or offered to the consumer with the opening only defined but not present. Such is the case in the embodiments of FIGS. 5A and 5B. In these embodiments, the arcuate or "smile" opening 15 of FIG. 5A is defined by the tear line 16 which is perforated to allow the user by pressure applied locally to the area within the perforated line 16 to sever or partially sever the lid region within the tear line and produce the opening 15. Until severed, the lid is relatively impervious to fluids.

The embodiment of FIG. 5B corresponds to that of FIG. 5 with a tear line 56 to sever the enclosed portion of lid 50 and open the segment shaped opening 55. This embodiment has the similar advantage of retaining beverages until ready for consumption.

Now referring to FIGS. 6 and 7, a further alternate embodiment of this invention may be seen. It involves a lid 60 having an uninterrupted rim 61, a tower or column 62 and air vent 63. A tear line 64 defines an arcuate "smile" opening similar to the embodiments of FIGS. 1 and 5A. In this case, however, the lid 60 included an upstanding generally frusto-conical tower 65 of diameter greater than the common sanitary straw, e.g. $\frac{1}{4}$ inch. The general shape of the tower 65 is better illustrated in FIGS. 7, 8, 9 and 10. The tower 65 may also be inverted and extend downward into the cup where to lids are expected to be used only with straws.

The tower 65 includes a second tear line 66 of circular shape and of diameter slightly larger than a sanitary straw whereby the tip of a straw 67 can sever or near sever the center 70 of the tower 65, as illustrated in FIG. 8, allowing the straw 67 to enter the container. The tower 65 acts as a target for the straw much like the crossed slots of the FIG. 2D. If the tower 65 is inverted, i.e. depressed below the level of the top as mentioned above, it defines a guide hole for the straw tip, allowing the straw to be inserted without looking at the container, e.g. while driving or in darkened locations. The upstanding tower 65, however is favored for the reasons illustrated in FIGS. 9 and 10.

Referring now to FIGS. 9 and 10, the lid 60 of FIG. 6 appears as it would when sealing a container such as cup 40 of the earlier figures. The tower 65 is ready to receive a sanitary straw as described above. However, in order to use the smile opening of this invention, the user need only either press or pull with his finger on the top of the tower, allowing the tower 65 to cause the first tear line 64 to rupture, producing the "smile" shaped opening of FIG. 1.

In any of the cases of the embodiments of FIGS. 1, 5, 5A, 5B, and 6, it is often desirable that the portion of the lid which forms the opening for consumption of the beverage not separate from the remainder of the lid. This is accomplished as illustrated in FIGS. 11 and 12. In such case, the tear line 64 does not extend fully around the opening area 66 but instead includes a small non-perforated portion 67. One must, by using their finger, tongue or straw, bend the tab 66 downward or upward out of the stream of beverage.

In each of the embodiments described above, there are two dimensions of the opening which are significent. They are labelled in FIG. 13 as the length L and the width W. I have studied and tasted the various sizes of openings possible using the arcuate shape of FIG. 1 and have found that the dimensions for an opening in accordance with this invention are as illustrated in FIG. 13. The length L should be no less than $\frac{3}{4}$ inch and no greater than $1\frac{1}{2}$ inch. The width W should be no less than 3/32 inch and no greater than $\frac{1}{4}$ inch. The optimum value combination is found to be:

$L = 1\frac{1}{4}$ inch
$W = 7/32$ inch for cold beverages, and $L = 1$ inch
$W = \frac{1}{8}$ inch for very hot beverages.

The relationship of the opening 15 to the typical adult mouth is illustrated in FIGS. 14, 15, 20 and 21. Reference is now made to FIG. 14. The length L, as defined in FIG. 13, is slightly less than the mouth opening with the lips pursed as normal in drinking from an open cup. This allows virtually the full normal mouth opening to be used in connection with this invention as when consuming a beverage from an open cup or container. Since the mouth is wider than the opening 15 is long, there is no danger of spillage or leakage from the ends of the openings. If the lid does not include an air vent, as is common, and the user finds that the flow of beverage has slowed due to a vacuum developing in the container, a slight relaxation of lip pressure allows air to pass through the corners or edges of the mouth and the ends of the opening 15, again without spillage.

Using this invention, the consumer of a beverage from a closed top container has virtually the same convenience with respect to drinking as he encounters drinking from an open cup or container. In the case of extremely hot beverages, he is protected from scalding his tongue since the stream of beverage is limited to a thin sheet spread over virtually the entire top of the tongue and the heat energy transfer is limited by the small quantity of beverage contacting each area of the sensitive tongue.

The operation of the invention as compared with the prior art is illustrated in FIGS. 16 through 21 which appear with FIG. 15 for aid in comprehension.

Figure 16:
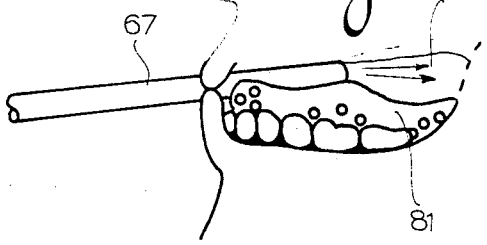
FIG. 16 is a simplified fragmentary vertical sectional view of a person consuming a beverage through a straw.
Figure 17:
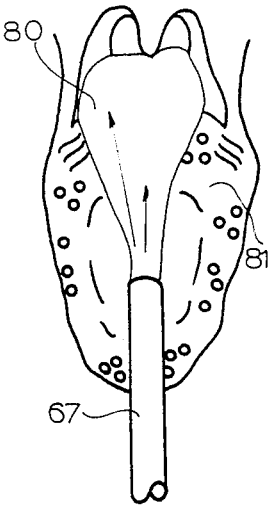
FIG. 17 is a simplified fragmentary top plan view of the tongue during consumption of a beverage through a straw.

In FIGS. 16 and 17, a person is consuming a beverage through a straw 67 which extends well into the person's mouth. The straw 67 produces a circular stream 80 which contacts the rear of the tongue 81 and does not contact the taste buds at the front of the tongue which are responsive to sweet flavors. Only through counterflow in the mouth do sweet beverages contact the front taste buds. Even if the person only inserts the tip of the straw in their mouth, only a small stream of beverage reaches the tongue and spreads out only after entering the mouth.

Although flavor sensations and their response to different persons are largely subjective and difficult to quantify, it stands to reason that less flavor transfer occurs in the case of sweet beverages where the beverage is introduced into the mouth beyond the sweet sensitive taste buds.

Figure 18:
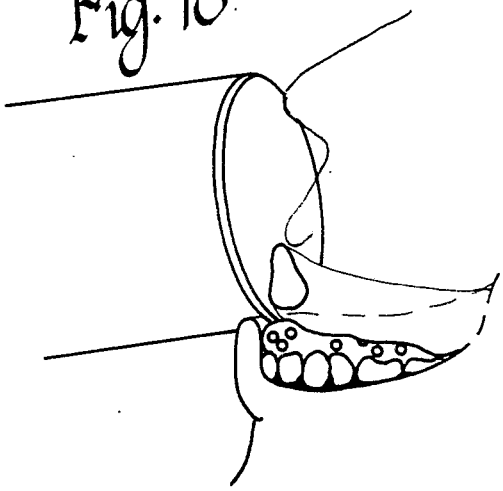
FIG. 18 is a simplified fragmentary vertical sectional view of a person consuming a beverage from a container of the type illustrated in FIGS. 2A and 2B.
Figure 19:
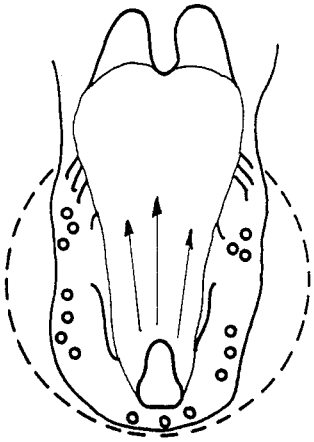
FIG. 19 is a fragmentary top plan view of the tongue of a person consuming a beverage as shown in FIG. 18.

In FIG. 18, the person is seen consuming a beverage from a container of the type illustrated in FIGS. 2A and 2B, both of which have large generally circular or pear-shaped openings. FIG. 19 shows that this stream is relatively narrow as compared to the width of the tongue and deep, in the order of several times the width W of the openings of this invention. The large stream issuing from such containers is conducive to gulping or pouring the contents down the throat of the consumer with virtual total loss of flavor benefit.

Figure 20:
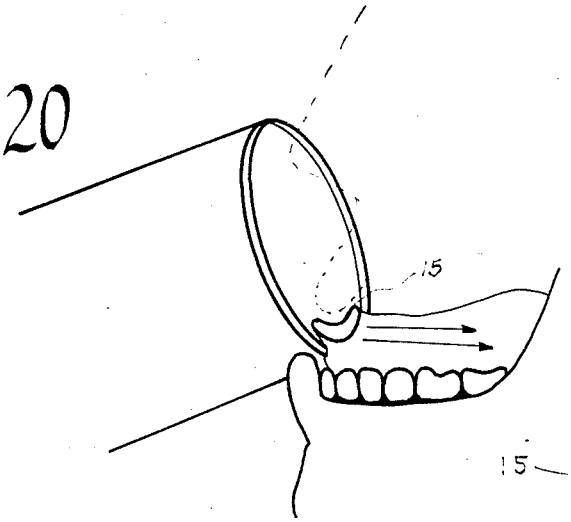
FIG. 20 is a fragmentary vertical sectional view of a person consuming a beverage from a container with a lid employing this invention.
Figure 21:
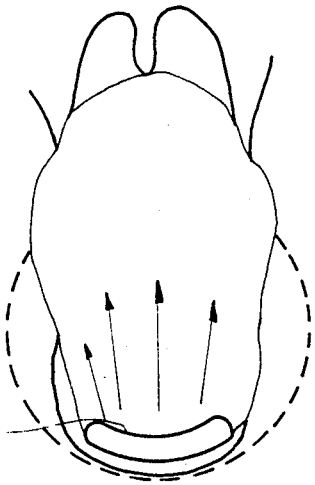
FIG. 21 is a fragmentary top plan view of the tongue of the person as shown in FIG. 20.

In contrast to the effects illustrated in FIGS. 16–19, the consumption of a beverage through the opening in accordance with this invention is shown in FIGS. 20 and 21. In these figures, the opening 15 has a width W which restricts the flow to a thin sheet spread over the full front of the tongue and spreads out from that width to virtually cover the tongue. The stream of beverage in spreading out thins to provide maximum contact with the upper surface of the tongue and its taste buds, particularly the taste buds at the front of the tongue. If the beverage is extremely hot, in spreading, its heat is rapidly dissipated and absorbed by the tongue with less liklihood of scalding the tngue than in the case of the embodiments of FIGS. 16 and 18. The consumer may also restrict the flow through the opening by partially blocking it with the tip of his tongue thereby not only reducing the flow but increasing the contact between the sweet sensitive taste buds of the tip of the tongue and the thin stream of beverage.

Employing this invention, I have also found that even with the opening present, a container with a lid of my invention and no air hole, may be inverted without loss of beverage. This is not recommended, except for demonstration, but does indicate its superiority in protection from spillage as well as improved flavor appreciation.

The above embodiments are merely representative of the concept of this invention and are not to be considered as limiting. It is recognized that one may without departing from the spirit and scope of this invention may produce structures not identical to those here disclosed. My invention is therefore defined by the following claims including their equivalents.

I claim:

1. A lid for single use beverage containers comprising:

a unitary plastic top of sheet form including an edge rim having a reentrant portion for receiving the lip of a single service beverage container;

said top including a severance line within said edge rim defining an arcuate region having a length extending generally along the inner side of the edge rim and a width extending generally radially;

the length and width of said region defined by said severance line being greater than the width thereof by a factor of at least five;

wherein said top includes a generally upward extending frusto-conical shape formed in said top within the region defined by said severance line and being confined to an area substantially smaller than the area defined by said arcuate region so that a major portion of said arcuate region is outside of said frusto-conical shape;

said frusto-conical shape being of sufficient size to be graspable to remove said region defined by said severance line;

said frusto-conical shape including a second severance line adjacent the extremity thereof dimensioned to enclose a region sufficient to receive a sanitary straw and penetrable thereby.

2. The combination in accordance with claim 1 wherein said second severance line is located in the top of said frusto-conical shape which is displaced upward from the surface of the container top whereby localized pressure by the tip of a sanitary straw on the frusto-conical shape will produce opening at said second severance line and entrance of the sanitary straw into the container and alternately whereby pressure applied to said frusto-conical portion by means broader than a sanitary straw tip such as a finger, to separate the arcuate portion from the top allows the consumption of the beverage through said arcuate opening.

* * * * *